US006612050B2

(12) United States Patent
Takeuchi

(10) Patent No.: US 6,612,050 B2
(45) Date of Patent: Sep. 2, 2003

(54) SCRAPER FOR SNOW REMOVING MACHINE AND SNOW REMOVING ATTACHMENT HAVING SCRAPER

(75) Inventor: Masashi Takeuchi, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 10/016,829

(22) Filed: Dec. 13, 2001

(65) Prior Publication Data

US 2002/0073581 A1 Jun. 20, 2002

(30) Foreign Application Priority Data

Dec. 15, 2000 (JP) ..... 2000-381434

(51) Int. Cl.[7] ..... E01H 5/04
(52) U.S. Cl. ..... 37/232
(58) Field of Search ..... 37/281, 232, 233, 37/264, 266, 446, 449, 460; 172/701.1, 701.3, 719, 772

(56) References Cited

U.S. PATENT DOCUMENTS 4,570,366 A * 2/1986 Yost ..... 37/232
5,471,770 A * 12/1995 Ferreira ..... 37/264
5,611,157 A * 3/1997 Ferreira ..... 37/449

FOREIGN PATENT DOCUMENTS

JP 51034105 8/1976
JP 52014347 3/1977

* cited by examiner

*Primary Examiner*—Robert E. Pezzuto
(74) *Attorney, Agent, or Firm*—Adams & Wilks

(57) ABSTRACT

A scraper is mountable on a snow removing machine for scraping snow on a road surface. The scraper has a polygonal prism member rotatably mountable to a lower end portion of a snow removing plate of a snow removing machine. The polygonal prism member has a first end, a second end disposed opposite the first end, surfaces disposed between the first and second ends, and a central hole extending throughout a length of the polygonal prism member from the first end to the second end. The scraper also has blades each removably connected to respective ones of the surfaces of the polygonal prism member. A rotation prevention device has a pair of rotation prevention members for preventing rotation of the polygonal prism member. Each of the rotation prevention members has a plate disposed on a respective one of the first and second ends of the polygonal prism member and fixedly mountable to the snow removing plate, a support shaft extending through the central hole of the polygonal prism member and connected to the polygonal prism member for rotation therewith, and a lock member for releasably locking the plate and the support shaft to one another to prevent rotation of the polygonal prism member.

31 Claims, 7 Drawing Sheets

SCRAPER FOR SNOW REMOVING MACHINE AND SNOW REMOVING ATTACHMENT HAVING SCRAPER

FIELD OF THE INVENTION

The present invention relates to a scraper for snow removal machines for scraping snow lying on road surfaces.

BACKGROUND OF THE INVENTION

A scraper for a snow removal machine of this kind is disclosed, for example, in Japanese Utility Model Laid-Open Publication No. SHO-51-34105 entitled "Snow Removing Case for Snow Removal Machine", and in Japanese Utility Model Laid-Open Publication No. SHO-52-14347 entitled "Bottom Scraping Blade for Snow Removal Machine".

SHO-51-34105 includes an auxiliary ground plate fastened with bolts to a lower end portion of the snow removing case. The ground plate is adjustable up and down as desired. When lowered, the plate prevents an auger from contacting the ground. When raised, the plate allows the auger to crush frozen snow, thus avoiding any large resistance which would otherwise be applied to the lower end portion of the snow removing case.

SHO-52-14347 includes a bottom scraping blade movably fitted in an arc-shaped long groove formed in a lower portion of an auger case. The scraping blade can be shifted upward and downward along the groove. To remove hard snow, the bottom scraping blade is held higher than the bottom of the auger so that the auger alone scrapes snow under reduced propulsion resistance, resulting in an efficient snow removal operation.

Augers can scrape frozen snow or trampled hard snow. When an auger contacts a surface of a roadway, a sidewalk or the like, it may scratch or damage the surface. For preventing such scratching, the auxiliary ground plate and the bottom scraping blade may be lowered. However, the ground plate and the scraping blade are generally made from steel plates and hence still have the possibility of scratching the ground.

To prevent such damage to a road surface, it is possible to replace a steel plate with a resin plate. In this case, however, it is troublesome to demount the auxiliary ground plate and the bottom scraping blade of one material and then mount those of the other material each time this becomes necessary.

Further, if the auxiliary ground plate and the bottom scraping blade are lowered to any unsuitable levels, they may strike road surfaces or hard objects such as stones and thus be damaged. It is quite hard to replace the damaged auxiliary ground plate and the bottom scraping blade with new ones on the spot.

SUMMARY OF THE INVENTION

It is therefore an object of the present invention to provide a scraper for a snow removal machine, which enables improved snow removal performance and easy blade change.

According to an aspect of the present invention, there is provided a scraper for a snow removal machine, mountable to a lower end portion of a snow removing plate, for scraping snow on a road surface, which comprises: a polygonal prism member rotatably mountable to the snow removing plate; a plurality of blades detachably attached to respective surfaces of the polygonal prism member; and a rotation prevention member for preventing rotation of the polygonal prism member.

The blades may be of the same material, or may be made from different kinds of material.

It is desired that the scraper has the blades attached to respective surfaces of the polygonal prism member. One of the blades is selected for use in accordance with snow quality, the kind of a pavement to be cleared of snow, and the condition of each blade. This enables efficient snow removing operation and protection of the pavement surface, thereby improving snow removing performance of the machine. The scraper has the blades provided on the polygonal prism member, and the rotation prevention member for preventing rotation of the polygonal prism member. The rotation prevention member prevents rotation of the polygonal prism member which has been rotated at a desired angle to select a desired blade. Thus, the change of blades is facilitated. When the blades are made of the same material and one of the blades used is deformed or damaged and becomes unusable, that blade can be replaced with another blade of the same material in a short time. Thus the change of blades of the same material is facilitated. When the blades are made of different kinds of material, one of the blades can be selected in accordance with snow quality or the kind of a pavement to be cleared of snow. For example, a steel blade is used to scrape hardened snow, and a resin blade is used to protect a pavement from being scratched. Such blades of different kinds of material enable selection of one of the blades in a short time. Thus the change of blades of different kinds of material is facilitated.

The scraper may further comprise a guiding/gap-closing member mountable to a lower end portion of the snow removing plate for closing a gap between the scraper and the snow removing plate and guiding transfer of snow from the scraper to the snow removing plate. The guiding/gap-closing member attached to the snow removing plate abuts against the scraper at the opposite side. Thus, a gap between the scraper to be rotated and the snow removing plate can be closed to prevent snow removed from leaking rearwards from the boundary between the scraper and the snow removing plate. When the scraper is rotated, part of the guiding/gap-closing member opposite to the scraper is pushed and bent by the scraper, not interfering with the scraper, and thereby allowing the scraper to rotate easily. Further the guiding/gap-closing member is mounted to guide transfer of snow from the scraper to the snow removing plate, enabling smooth transfer of snow, and thereby improving the snow removing performance of the machine.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
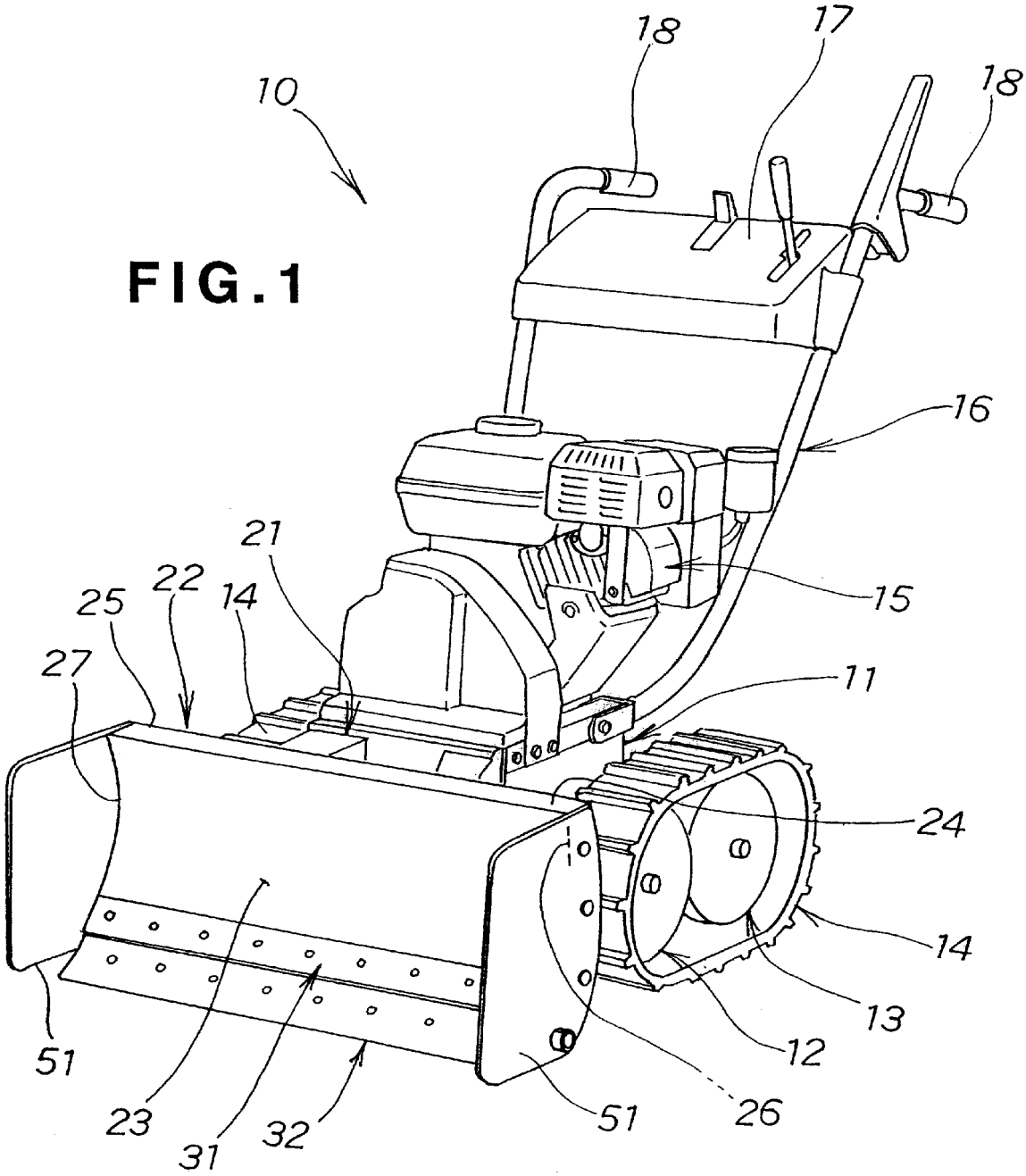
FIG. 1 is a perspective view of a snow removal machine according to the present invention.

Referring to FIG. 1, a snow removal machine 10 has a body frame 11, left and right crawler belts 14, 14 mounted to the left and right sides of the body frame 11 via left and right drive wheels 12, 12 and driven wheels 13, 13 (the right drive and driven wheels 12, 13 are invisible in the figure), an engine 15 mounted to the body frame 11, a control handle 16 mounted rearward of the body frame 11, a control panel 17 provided to an upper portion of the control handle 16, left and right grips 18, 18 provided to rear ends of the control handle 16, and a snow removing attachment mounted to the front of the body frame 11 via a supporter 21.

The snow removing device comprises a snow removing plate 22 having a plate body 23 formed in a sectionally arch shape, reinforcing plates 26, 27 mounted to left and right ends 24, 25 of the plate body 23, a guiding/gap-closing member 31 and a scraper 32 mounted to a lower end portion of the plate body 23.

Figure 2:
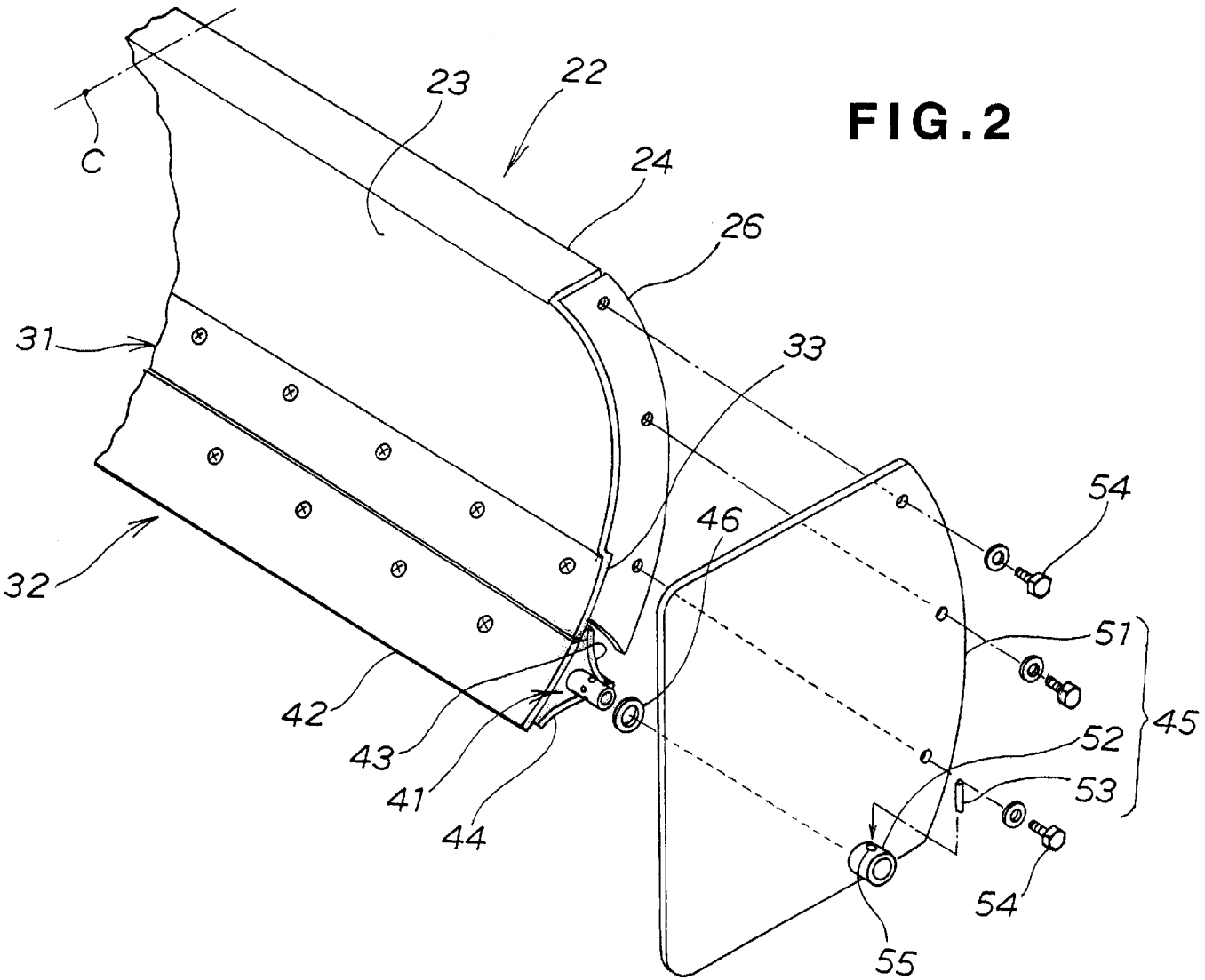
FIG. 2 is a perspective view illustrating on an enlarged scale part of a snow removing plate shown in FIG. 1.

In FIG. 2, the snow removing plate 22 is shown in perspective. The reinforcing plate 26 is attached to the left end 24 of the plate body 23. The guiding/gap-closing member 31 and the scraper 32 are attached to the lower end portion of the plate body 23. The snow removing plate 22 is symmetrical with respect to the centerline C. The plate body 23 has a closing member mounting part 33 at its lower end portion.

The scraper 32 has a polygonal prism member 41 rotatably mounted to the snow removing plate 22, a first blade 42, a second blade 43, and a third blade 44 mounted to the polygonal prism member 41, and a rotation prevention device comprising a pair of rotation prevention members 45 for preventing rotation of the polygonal prism member 41. Reference numeral 46 denotes a ring.

One of the rotation prevention members 45 is provided on the left side of the scrape 32 and includes a fixed plate 51 mounted to the reinforcing plate 26, a tubular spindle retaining part 52 provided at a lower portion of the fixed plate 51, and a pin 53 to be inserted into the spindle retaining part 52. In this embodiment, the spindle retaining part is generally cylindrical-shaped. The fixed plate 51 is mounted to the reinforcing plate 26 with a plurality of bolts 54. The other rotation prevention member 45 is provided on the right side of the scraper 32 and includes a fixed plate 51 mounted to the reinforcing plate 27 (See FIG. 1), a spindle retaining part 52 and a lock member in the form of a pin 53. The spindle retaining part 52 has a pinhole 55 for receiving the pin 53.

Figure 3:
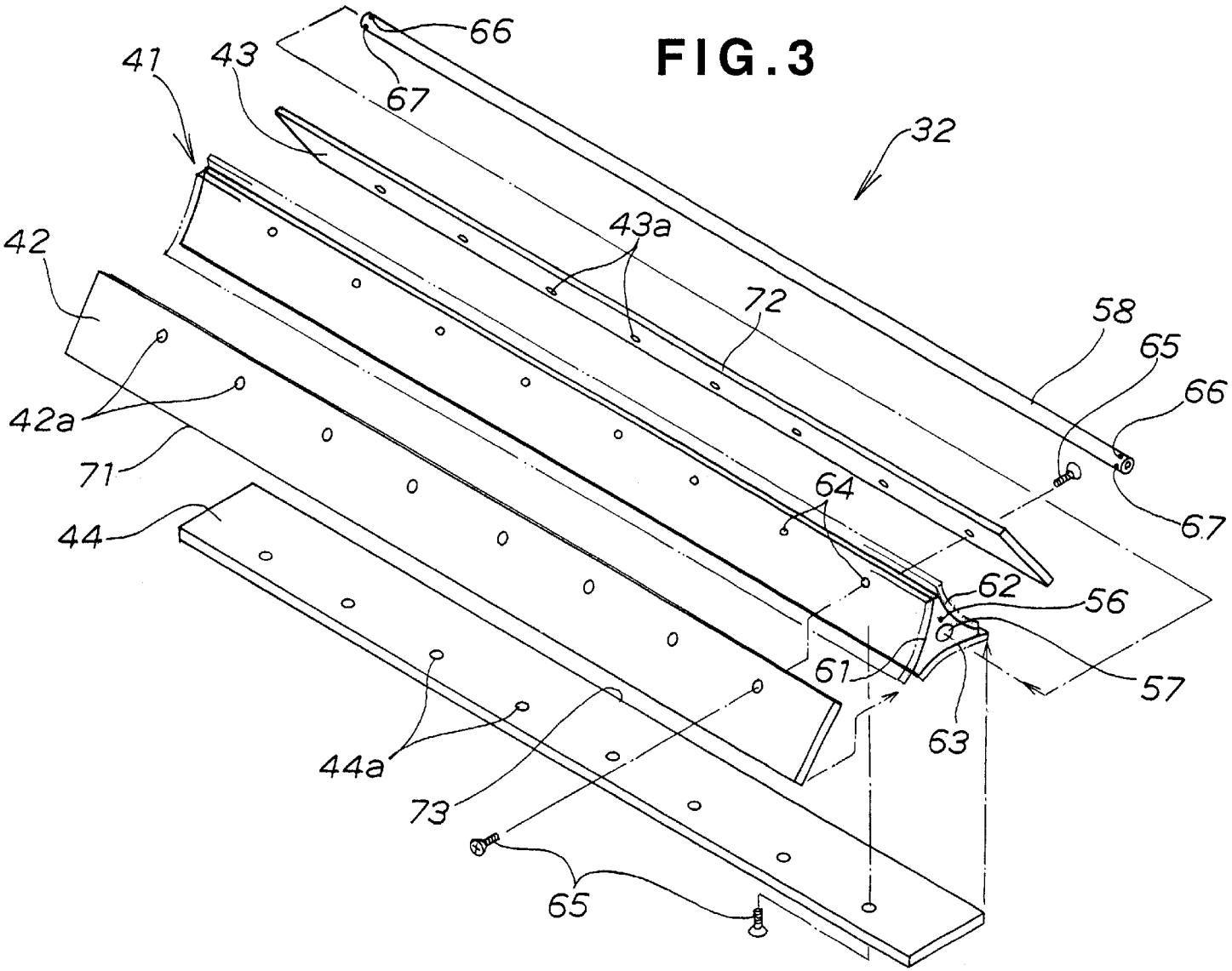
FIG. 3 is an exploded view of a scraper according to a first embodiment shown in FIG. 2.

Reference is now made to FIG. 3 showing the scraper in an exploded state. The polygonal prism member 41 has a body 56 of a generally triangular prism made from a steel material in this embodiment. A hole 57 is formed centrally of the body 56 in the longitudinal direction. A support shaft in the form of a spindle 58 is inserted into the hole 57 and fixed to the body 56 by welding. The body 56 has a first surface 61, a second surface 62 and a third surface 63 which constitute the outer periphery thereof. Those surfaces are in a curved shape. The surfaces 61, 62 and 63 are formed with a plurality of female threads 64, respectively.

Figure 5A:
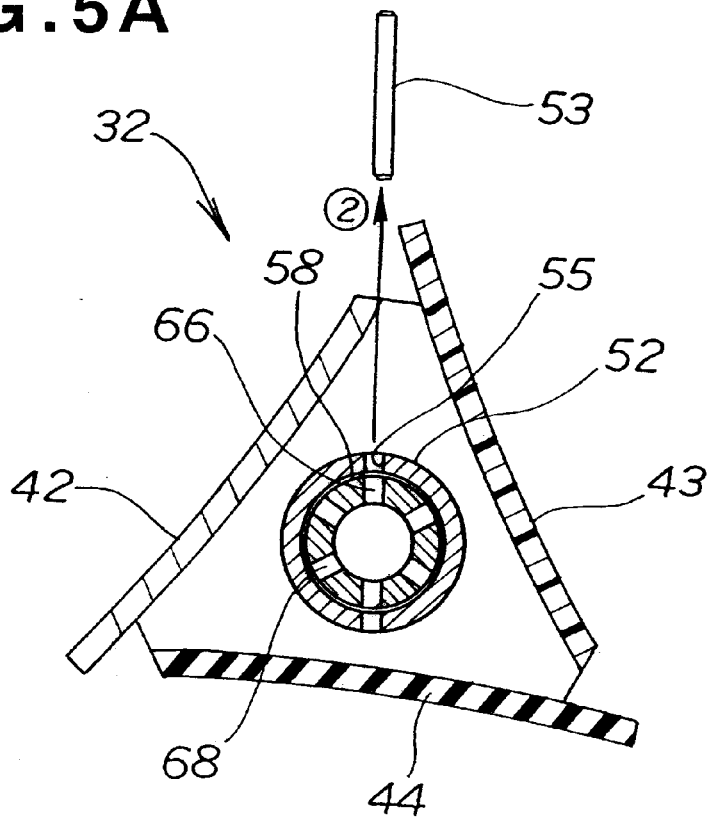
FIGS. 5A and 5B are functional diagrams showing the mounting and changing of a plurality of blades of the scraper.
Figure 5B:
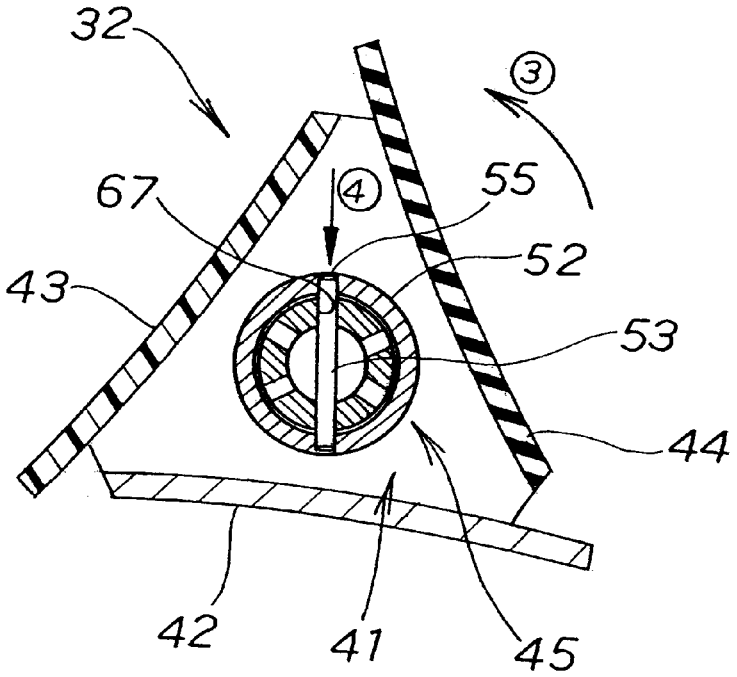

The spindle 58 has, at each of the opposite ends, as shown in FIGS. 5A and 5B, a first angle setting hole 66, a second angle setting hole 67, and a third angle setting hole 68 provided as through holes, which are arranged at intervals of 120 degrees.

Description will now be made as to the blades 42, 43 and 44 of the scraper 32.

The first blade 42, the second blade 43, and the third blade 44 are made from different kinds of material. Specifically, the first blade 42 is made from a steel material, the second blade 43 a resin material, and the third blade 44 rubber.

The first blade 42 has a plurality of mounting holes 42*a* corresponding to the female threads 64 formed in the polygonal prism member 41, and is fixed to the first surface 61 of the polygonal prism member 41 with bolts 65 screwed through the mounting holes 42*a* into the female threads 64. The first blade 42 has a cutting edge 71 in the longitudinal direction.

The second blade 43 has a plurality of mounting holes 43*a* corresponding to the female threads 64 and is fixed to the second surface 62 of the polygonal prism member 41 with bolts 65 screwed through the mounting holes 43*a*. The second blade 43 has a cutting edge 72 in the longitudinal direction.

The third blade 44 has a plurality of mounting holes 44*a* corresponding to the female threads 64 and is fixed to the third surface 63 of the polygonal prism member 41 with bolts 65 screwed through the mounting holes 44*a*. The third blade 44 has a cutting edge 73 in the longitudinal direction.

Figure 4:
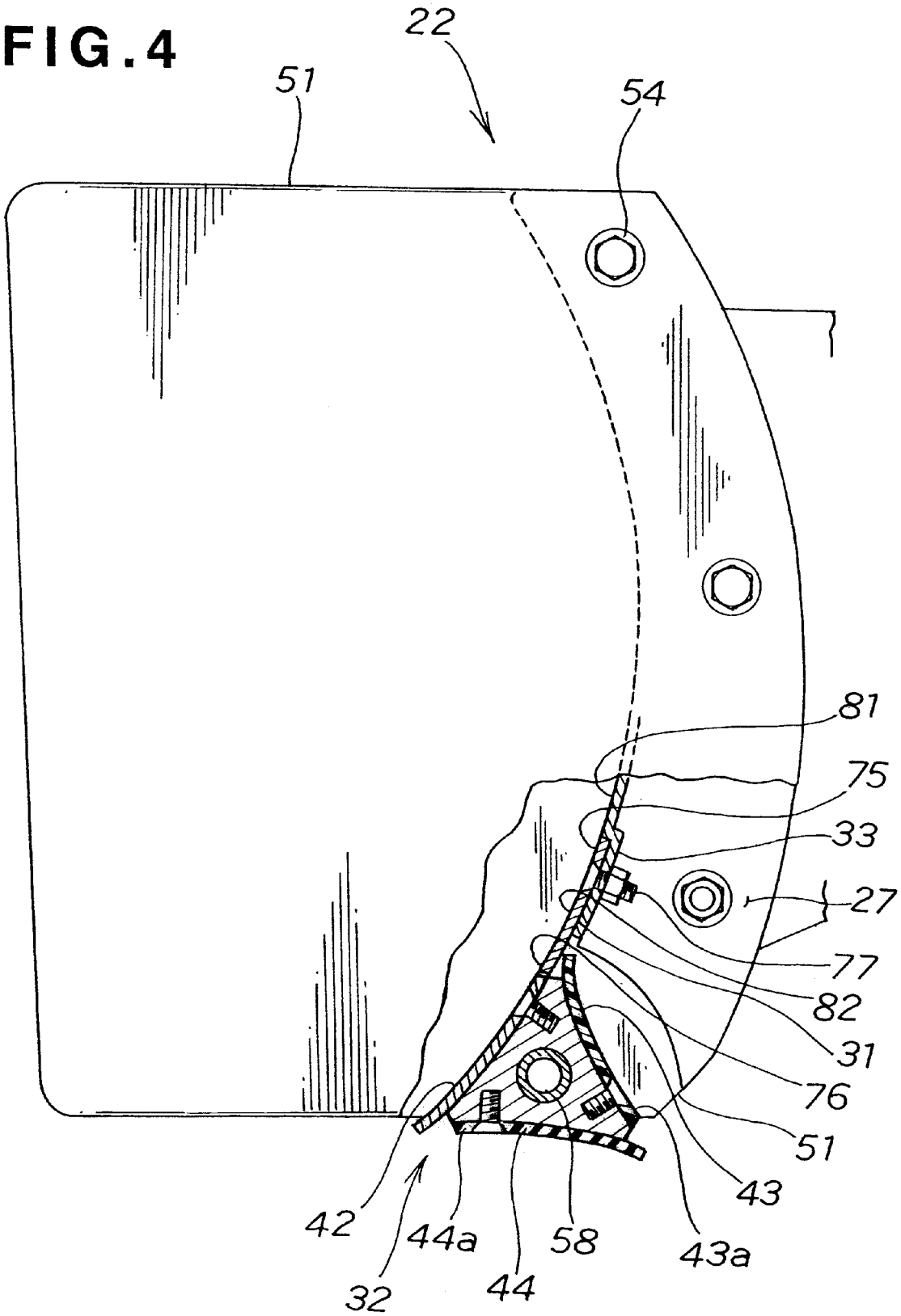
FIG. 4 is a side view of the snow removing plate shown in FIG. 2 with its part cutaway.

Reference is made next to FIG. 4 showing in side elevation the snow removing plate 22, with the scraper 32 and its surroundings shown in cross-section. The scraper 32 is mounted to a rear lower portion of the snow removing plate 22. The guiding/gap-closing member 31 is mounted to the closing member mounting part 33.

The guiding/gap-closing member 31 has an upper-half mounting part 75 mounted to the closing member mounting part 33 with bolts 77, and a lower-half seat part 76.

The guiding/gap-closing member 31 is mounted to the closing member mounting part 33 in a manner that a surface 82 of the guiding/gap-closing member 31 is coplanar with a surface 81 of the snow removing plate 22. The upper edge of the first blade 42 of the scraper 32 substantially abuts against the lower edge of the seat part 76. The seat part 76 also substantially abuts against the second blade 43 and the third blade 44 when the scraper 32 is rotated as described later.

Now, an operation of the scraper for the snow removal machine will be described with reference to FIGS. 5A to 6C.

FIG. 5A shows that one of the three blades 42, 43 and 44 attached to the scraper 32 is selected for use in accordance with the state of snow on a road surface. The first angle setting hole 66, the second angle setting hole 67, and the third angle setting hole 68 are provided in the spindle 58 with 120 degree pitches as described above. When the pin 53 is inserted into the spindle retaining part 52, passing through the first angle setting hole 66, the first blade 42 of steel material is selected and locked for use. To change the blade, the pin 53 is pulled out as shown by arrow ② to release the lock, thereby making the scraper 32 rotatable.

FIG. 5B shows that the scraper 32 is rotated counterclockwise in the figure (in the direction of arrow ③) at a predetermined angle, making the second angle setting hole 67 communicate with the pinhole 55. The pin 53 is inserted into the spindle retaining part 52, passing through the second angle setting hole 67 as shown by arrow ④. In this state, the second blade 43 of resin material is selected and is locked for use.

To select the third blade 44, the pin 53 is pulled out and inserted similarly.

Thus, with the first, second and third blades 42, 43 and 44 mounted to the polygonal prism member 41 and the pin 53 of the rotation prevention member 45 pulled out from the retaining part 52, the scraper 32 can be rotated for blade change. This facilitates the change of blades of the scraper 32.

Figure 6A:
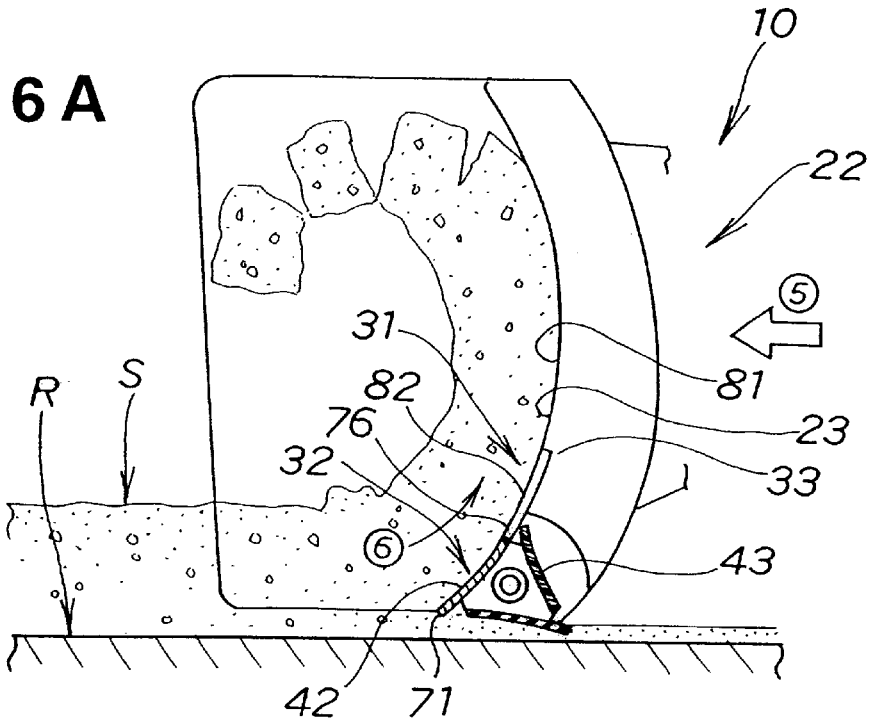
FIGS. 6A to 6C are functional diagrams of the scraper according to the present invention in a snow removing operation.

In FIG. 6A, the snow removal machine 10 is propelled (in the direction of arrow ⑤) with the scraper 32 cutting through snow S on road surface R, scraping the snow S for removal. In this case, the first blade 42 of the scraper 32 is used to relatively easily scrape hardened snow with the cutting edge 71 of steel. The scraper 32 can thus handle hardened snow.

When the seat part 76 of the guiding/gap-closing member 31 is made to substantially abut against the scraper 32, closing a gap between the scraper 32 and the snow removing plate 22, any gap hardly remains between the scraper 32 and the plate body 23. As a result, the snow removing plate 22 can remove snow without leaking rearward, thereby improving efficiency in snow removing operation. When the first blade 42 is replaced with the second blade 43, the guiding/gap-closing member 31 also substantially abuts at the seat part 76 against the second blade 43.

Since the guiding/gap-closing member 31 is mounted to the closing member mounting part 33 at the lower end of the snow removing plate 22, and the surface 82 of the guiding/gap-closing member 31 is set coplanar with the surface 81 of the snow removing plate 22, and the guiding/gap-closing member 31 guides the transfer of snow S from the scraper 32 to the snow removing plate 22 as shown by arrow ⑥, the snow S can be smoothly transferred, resulting in improved snow removing performance of the machine 10.

Figure 6B:
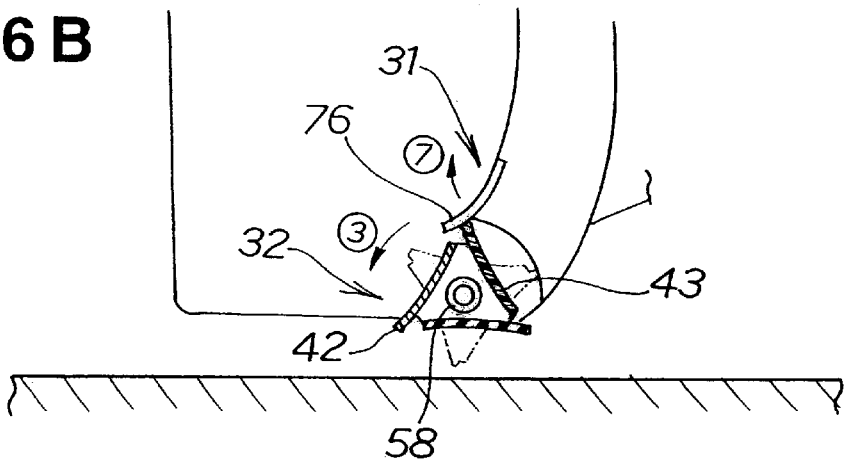

In FIG. 6B, the scraper 32 is rotated counterclockwise (in the direction of arrow ③), the first blade 42 being replaced with the second blade 43. At this time, the second blade 43 comes into contact with the seat part 76 of the guiding/gap-closing member 31. The guiding/gap-closing member 31 bends as shown by arrow ⑦, avoiding interfering with the scraper 32, and thereby not preventing the rotation of the scraper 32.

Figure 6C:
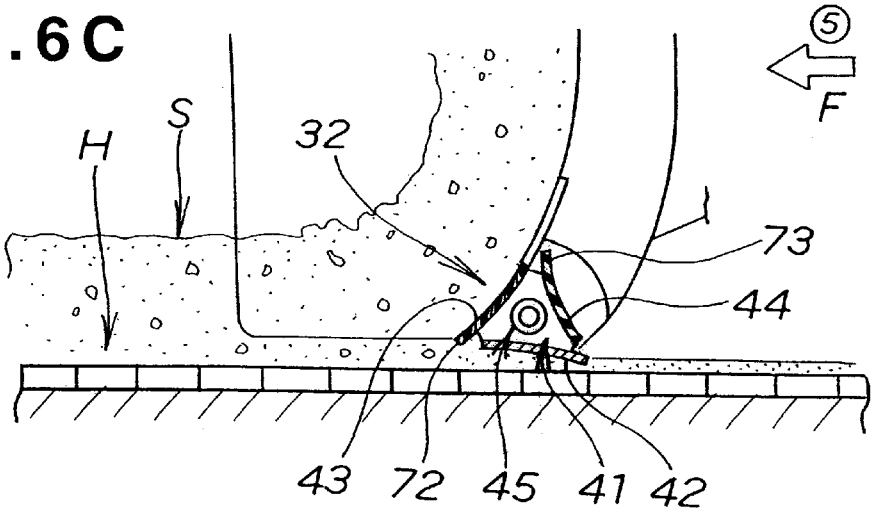

In FIG. 6C, the blade of the scraper 32 is changed to the second blade 43 with the cutting edge 72 of resin for removing snow on sidewalk H surfaced with a relatively sensitive material such as tiles or lumber. When pushed onto the surface of the sidewalk H, the cutting edge 72 is resiliently deformed, reducing pushing force F, and thereby causing no scratches on the sensitive surface of the sidewalk H.

When the third blade 44 is set as the blade of the scraper 32, the cutting edge 73 of rubber can scrape relatively hard snow, and scraping noise can be reduced. This allows snow removal with the machine to be performed even during early mornings and late nights without annoyance.

Since the first blade 42 of steel, the second blade 43 of resin, and the third blade 44 of rubber are thus attached to the polygonal prism member 41, and the polygonal prism member 41 is supported by the rotation prevention member 45, a desired blade can be selected for use in a short time in accordance with a road surface to be cleared of snow and the state of snow. As a result, the scraper 32 can efficiently remove snow of different states, from hardened snow to soft snow, alone, while avoiding scratching the surface of a roadway or sidewalk, thereby improving the snow removing performance of the machine 10.

Now, a scraper according to a second embodiment will be described with reference to FIGS. 7 and 8.

Like elements as in FIGS. 2 to 5B of the first embodiment are referred with like reference numerals to omit the description thereof.

Figure 7:
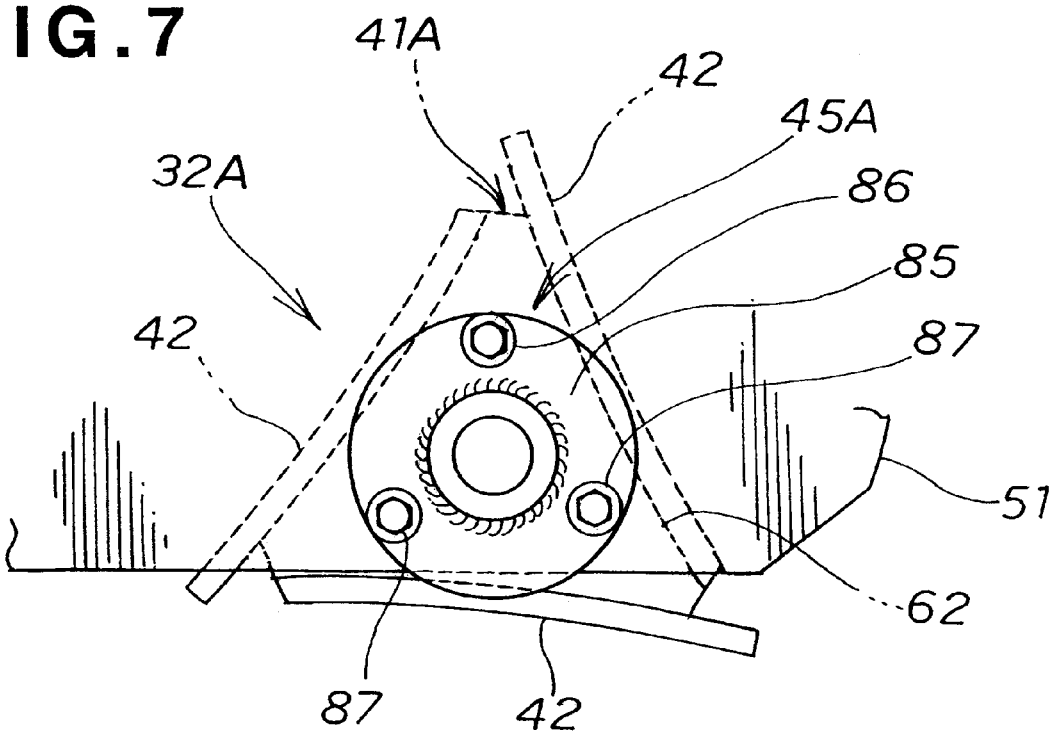
FIG. 7 is a side view of a scraper according to a second embodiment.

FIG. 7 shows a scraper 32A according to the second embodiment having all blades made from the same material. Specifically, a first blade 42, a second blade 42, and a third blade 42 are all made of steel material. These three blades 42, 42, 42 are provided on a polygonal prism member 41A. The scraper 32A has a positioning hole 84 formed in an end face of the polygonal prism member 41A (See FIG. 8) and a rotation prevention member 45A. The rotation prevention member 45A includes a fixed plate 51, a supporting member 85 attached to the fixed plate 51, a locking bolt 86, and mounting bolts 87, 87.

Figure 8:
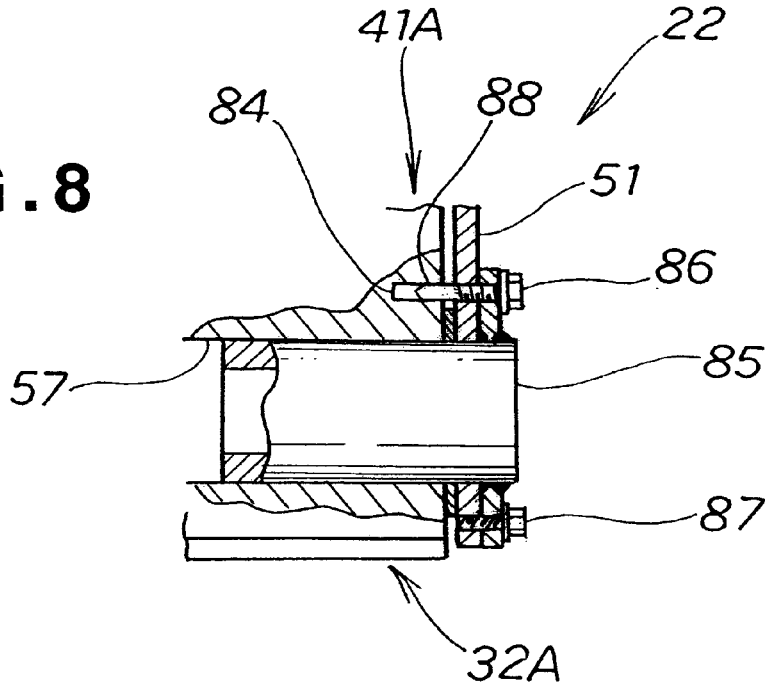
FIG. 8 is a cross-sectional view of the scraper shown in FIG. 7.

In FIG. 8, the supporting member 85 is fitted into a central hole 57 of the polygonal prism member 41A, a pin 88 of the locking bolt 86 is fitted into the positioning hole 84, and the mounting bolts 87 are tightened, thereby attaching the scraper 32A to the snow removing plate 22.

In the second embodiment, since the three blades of the scraper 32A are made of the same steel material, if the first blade 42 is deformed or damaged, rotation of the scraper 32A is all that is needed to replace the blade with the second blade 42 attached to a second surface 62. This enables replacement with a new blade of the same material to occur in a short time, resulting in very easy blade change.

In the embodiment shown in FIGS. 7 and 8, the three blades are made of the same steel material. These blades may be made of resin material, rubber, or other material.

The polygonal prism member 41 having the blades of different kinds of material attached thereto and the rotation prevention member 45A using the bolts as shown in FIGS. 7 and 8 may be combined. Also, the pin 53 and the polygonal prism member 41A having the blades of the same material attached thereto may be combined.

The present disclosure relates to the subject matter of Japanese Patent Application No. 2000-381434, filed Dec. 15, 2000, the disclosure of which is expressly incorporated herein by reference in its entirety.

What is claimed is:

1. A scraper mountable on a snow removing machine for scraping snow on a road surface, the scraper comprising:

a polygonal prism member rotatably mountable to a lower end portion of a snow removing plate of a snow removing machine, the polygonal prism member having a first end, a second end disposed opposite the first end, a plurality of surfaces disposed between the first and second ends, and a central hole extending throughout a length of the polygonal prism member from the first end to the second end;

a plurality of blades each removably connected to respective ones of the surfaces of the polygonal prism member; and a rotation prevention device having a pair of rotation prevention members for preventing rotation of the polygonal prism member, each of the rotation prevention members having a plate disposed on a respective one of the first and second ends of the polygonal prism member and fixedly mountable to the snow removing plate, a support shaft extending through the central hole of the polygonal prism member and connected to the polygonal prism member for rotation therewith, and a lock member for releasably locking the plate and the support shaft to one another to prevent rotation of the polygonal prism member.

2. A scraper according to claim 1; wherein the blades are made from the same material.

3. A scraper according to claim 1; wherein the blades are made from different types of materials.

4. A scraper according to claim 1; further comprising a guiding/gap-closing member mountable to the lower end portion of the snow removing plate for closing a gap between the scraper and the snow removing plate and for guiding transfer of snow from the scraper to the snow removing plate.

5. A scraper according to claim 1; wherein each plate of the rotation prevention members has a tubular retaining part and a pin hole extending diametrically across the tubular retaining part.

6. A scraper according to claim 5; wherein each of the first and second ends of the support shaft has a plurality of through-holes disposed at equal angular intervals in a circumferential direction of the support shaft for selective alignment with the pin hole in the respective tubular retaining part of the rotation prevention members.

7. A scraper according to claim 6; wherein the through-holes in each of the first and second ends of the support shaft correspond in number to the number of surfaces of the polygonal prism member.

8. A scraper according to claim 7; wherein the lock member of each of the rotation prevention members comprises a pin extending through the pinhole of a respective one of the tubular retaining parts and one of the through-holes of the respective first and second ends of the support shaft.

9. A scraper mountable on a snow removal machine for scraping snow on a road surface, the scraper comprising:

a polygonal prism member rotatably mountable to a lower end portion of a snow removing plate of a snow removing machine, the polygonal prism member having a first end, a second end disposed opposite the first end, a plurality of surfaces disposed between the first and second ends, and a central hole extending throughout a length of the polygonal prism member from the first end to the second end;

a plurality of blades each removably connected to respective ones of the surfaces of the polygonal prism member; and a rotation prevention device having a pair of rotation prevention members for preventing rotation of the polygonal prism member, each of the rotation prevention members having a plate disposed on a respective one of the first and second ends of the polygonal prism member and fixedly mountable to the snow removing plate, a support shaft integrally connected to the plate and extending through the central hole of the polygonal prism member to allow rotation of the polygonal prism member relative to the support shaft, and a lock member for releasably locking the plate and the polygonal prism member to one another to prevent rotation of the polygonal prism member.

10. A scraper according to claim 9; wherein the polygonal prism member has a plurality of positioning holes formed in the first and second ends of the polygonal prism member at equal angular intervals about an axis of the central hole.

11. A scraper according to claim 10; wherein the positioning holes correspond in number to the number of surfaces of the polygonal prism member.

12. A scraper according to claim 11; further comprising a pair of locking bolts each for integrally connecting a respective one of the plates to the support shaft, each of the locking bolts having a pin portion defining the lock member for insertion into one of the positioning holes of the polygonal prism member.

13. A scraper according to claim 9; wherein the blades are made from the same material.

14. A scraper according to claim 9; wherein the blades are made from different types of materials.

15. A scraper according to claim 9; further comprising a guiding/gapclosing member mountable to the lower end portion of the snow removing plate for closing a gap between the scraper and the snow removing plate and for guiding transfer of snow from the scraper to the snow removing plate.

16. A snow removing attachment for a snow removing machine, the snow removing attachment comprising:

a snow removing plate for removing snow from a ground surface during a snow removal operation, the snow removing plate having a plate body, a pair of side plates connected to opposite sides of the plate body, a polygonal prism member rotationally mounted to a lower end portion of the plate body and having a plurality of surfaces, and a plurality of blades each removably connected to respective ones of the surfaces of the polygonal prism member; and rotation preventing means for preventing rotation of the polygonal prism member relative to the plate body of the snow removing plate during a snow removal operation.

17. A snow removing attachment according to claim 16; wherein the rotation preventing means comprises a support shaft extending through a central hole of the polygonal prism member and connected to the polygonal prism member for rotation therewith, a pair of tubular retaining members each connected to a respective one of the side plates for receiving a corresponding end portion of the support shaft, and pair of locking members each for releasably locking the end portions of the support shaft to respective ones of the tubular retaining members to prevent rotation of the polygonal prism member relative to the plate body during a snow removal operation.

18. A snow removing attachment according to claim 17; wherein each of the tubular retaining members has a pin hole extending diametrically across the tubular retaining member.

19. A snow removing attachment according to claim 18; wherein each end portion of the support shaft has a plurality of through-holes disposed at equal angular intervals in a circumferential direction of the support shaft for selective alignment with the pin hole of a respective one of the tubular retaining members.

20. A snow removing attachment according to claim 19; wherein the through-holes in each end portion of the support shaft corresponds in number to the number of surfaces of the polygonal prism member.

21. A snow removing attachment according to claim 20; wherein each of the locking members comprises a pin extending through the pinhole of a respective one of the tubular retaining members and one of the through-holes of a corresponding respective one of the end portions of the support shaft.

22. A snow removing attachment according to claim 17; wherein the blades are made from the same material.

23. A snow removing attachment according to claim 17; wherein the blades are made from different types of materials.

24. A snow removing attachment according to claim 17; further comprising a guiding/gap-closing member mounted on the lower end portion of the plate body for closing a gap between the polygonal prism member and the plate body.

25. A snow removing attachment according to claim 16; wherein the rotation preventing means comprises a support shaft integrally connected to side plates and extending through a central hole of the polygonal prism member to allow rotation of the polygonal prism member relative to the support shaft, and pair of locking members each for releasably locking respective ones of the side plates to the polygonal prism member to prevent rotation of the polygonal prism member relative to the plate body during a snow removal operation.

26. A snow removing attachment according to claim 25; wherein the polygonal prism member has a plurality of positioning holes formed at opposite ends of the polygonal prism member at equal angular intervals about an axis of the central hole.

27. A snow removing attachment according to claim 26; wherein the positioning holes correspond in number to the number of surfaces of the polygonal prism member.

28. A snow removing attachment according to claim 27; further comprising a pair of locking bolts each for integrally connecting a respective one of the side plates to respective end portions of the support shaft, each of the locking bolts having a pin portion defining the locking member for insertion into one of the positioning holes of the polygonal prism member.

29. A snow removing attachment according to claim 25; wherein the blades are made from the same material.

30. A snow removing attachment according to claim 25; wherein the blades are made from different types of materials.

31. A snow removing attachment according to claim 25; further comprising a guiding/gap-closing member mounted on the lower end portion of the plate body for closing a gap between the polygonal prism member and the plate body.

* * * * *